United States Patent [19]

Liesch et al.

[11] Patent Number: 4,548,503

[45] Date of Patent: Oct. 22, 1985

[54] METHOD OF AND APPARATUS FOR MONITORING A DYNAMIC CONDITION OF ROLLING-MILL ROLLS

[75] Inventors: Jean Liesch; Jacques Metzdorf, both of Esch; André Meyers; Joseph Neu, both of Pontpierre; Jean Redo, Esch, all of Luxembourg

[73] Assignee: Arbed S.A., Luxembourg, Luxembourg

[21] Appl. No.: 465,995

[22] Filed: Feb. 11, 1983

[30] Foreign Application Priority Data

May 12, 1982 [LU] Luxembourg ..... 84145

[51] Int. Cl.[4] ..... B23Q 15/00; B23Q 15/12; G01B 9/08; G01B 11/14

[52] U.S. Cl. ..... 356/373; 356/394; 356/400; 72/35

[58] Field of Search ..... 356/373, 375, 379, 394, 356/400, 401, 399; 72/35, 37

[56] References Cited

U.S. PATENT DOCUMENTS

| | | | |
|---|---|---|---|
| 2,332,289 | 10/1943 | Zeitlin | 72/37 |
| 3,573,472 | 4/1971 | Madalo | 356/394 |
| 3,640,109 | 2/1972 | Ashton et al. | 356/375 |
| 3,943,278 | 3/1976 | Ramsey, Jr. | 356/394 |
| 4,456,378 | 6/1984 | Goldowsky et al. | 356/375 |

*Primary Examiner*—R. A. Rosenberger
*Assistant Examiner*—Michael Vollero
*Attorney, Agent, or Firm*—Karl F. Ross; Herbert Dubno

[57] ABSTRACT

The geometry of rolling-mill rolls is monitored dynamically by projecting light between portions of the two rolls which are formed with circumferential grooves and the resulting light pattern is detected and compared with a pattern prior to start of the rolling operation.

6 Claims, 5 Drawing Figures

METHOD OF AND APPARATUS FOR MONITORING A DYNAMIC CONDITION OF ROLLING-MILL ROLLS

FIELD OF THE INVENTION

Our present invention relates to a method of and an apparatus for the dynamic monitoring of the displacement and/or eccentricity of rolling-mill rolls and, especially, the change in the positions of the rolled surfaces which result from relative vertical or relative horizontal displacement of the two rolls or from a developing eccentricity of one or both of these surfaces.

BACKGROUND OF THE INVENTION

Rolling-mill rolls are generally mounted in a rolling-mill stand or frame in respective bearings to the end of the rolls and are used for rolling billets, blooms or bars of metal in the hot or cold state to produce a variety of rolled products.

The displacement or change of mutual spacing of the rolls during the rolling operation is an inevitable phenomenon which depends on a number of factors.

Thus, while the two rolls may be held in position to define a predetermined gap between them by means at the bearing and even back-up rolls along the lengths of the rolling rolls, some degree of vertical displacement or change in the gap width can result in a dependence upon the physical properties and the geometry of the object which is rolled, the temperature at which the rolling is carried out, the conformation and composition of the roll, the play in the roll bearings, and elongation or other change of shape or dimensions of the rolling mill stand or frame. A relative offset in the horizontal direction will generally depend upon horizontal components of such play.

While the effect of a horizontal offset is not decisive for rolling flat objects such as strips, it is crucial in the rolling of shaped objects or profiles such as small bars, angles, rails, I-beams, H-beams and the like.

Indeed, even the slightest of horizontal offsets may be detrimental to the quality of rolled products of the latter type where geometry is important.

In practice, therefore, it has been found that the product quality depends to a considerable extend on preventing excessive offsets in both the vertical and horizontal directions and on preventing rolling by rolls which develop excentricities of the rolling surfaces.

It has already been proposed to provide means for measuring the spread of the rolls or the spread of the rolling surfaces of the rolls of a rolling mill, utilizing a discontinuance or periodic measurement approach and appropriate mechanical or optical means. Of course, should a defective operating state arise, this can only be observed after the system has been brought to standstill and an appropriate measurement taken.

OBJECTS OF THE INVENTION

It is, therefore, the principal object of the present invention to provide an improved method of continuously monitoring the state of a pair of rolling-mill rolls to be able to respond rapidly during the rolling operation to the development of a vertical or horizontal excursion of one of the rolls relative to the other or to the development of an eccentric condition.

Another object of this invention is to provide a monitoring apparatus capable of the dynamic and continuous monitoring of the state of a pair of rolling-mill rolls whereby disadvantages of earlier rolling mill systems can be obviated.

Still another object of our invention is to provide a method of and an apparatus for the dynamic and continuous monitoring of the overall geometric relationship of a pair of rolling-mill rolls so as to be able to respond immediately and rapidly to a disadvantageous change in the geometry representing a deviation from predetermined tolerances and relative vertical and horizontal positioning and to the development of an undesirable eccentric condition.

SUMMARY OF THE INVENTION

These objects and others which will become apparent hereinafter are attained, in accordance with the invention, by providing each of a pair of rolling-mill rolls with a respective outwardly open circumferential groove and forming these grooves in a common vertical plane, perpendicular to the axis of the rolls, and by directing at least one light beam through the registering grooves while detecting a geometric pattern on the opposite side from the light source. This pattern is compared, according to the invention, with at least one other pattern such as the pattern obtained at the beginning of rolling and any unacceptable deviation is utilized to produce a signal or to trigger corrective action or termination of the rolling operation.

According to the invention, the grooves are symmetrical with respect to the aforementioned plane and thus have centers which are aligned in the vertical direction. The light beam may comprise a horizontal bundle of light rays which are received and registered after they traverse the space defined between rolls and by the flanks of the grooves.

Preferably, each groove is of a V-cross section with the vertex of the V lying in the aforementioned vertical plane of the normal rolling positions of the two rolls. A horizontal dislocation of the vertex of the V from this plane or relative to the other vertex will thus be a measure of the degree of geometric instability of the pair of rolls. The monitoring is thus carried out continuously and continuous adjustment is possible.

Any tendency toward the development of a defect state is thus readily eliminated.

The geometric stability in the vertical sense is likewise readily detected from the changing pattern and, of course, fluctuations in the patterns will signal a developing excentricity.

The optical source can be any source capable of projecting a light beam which will generate a pattern on the opposite side of the rolls. Preferably the source comprises an array of individual laser beam sources. This array can have the configuration of a lattice or matrix consisting of a plurality of rows of spaced-apart laser beams in each row. Each of the laser beams can be trained upon a respective detector and the pattern can be established by which of the detectors is energized.

The system can include a memory for recording the initial pattern or any acceptable geometric pattern as well as acceptable deviations from the original pattern.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
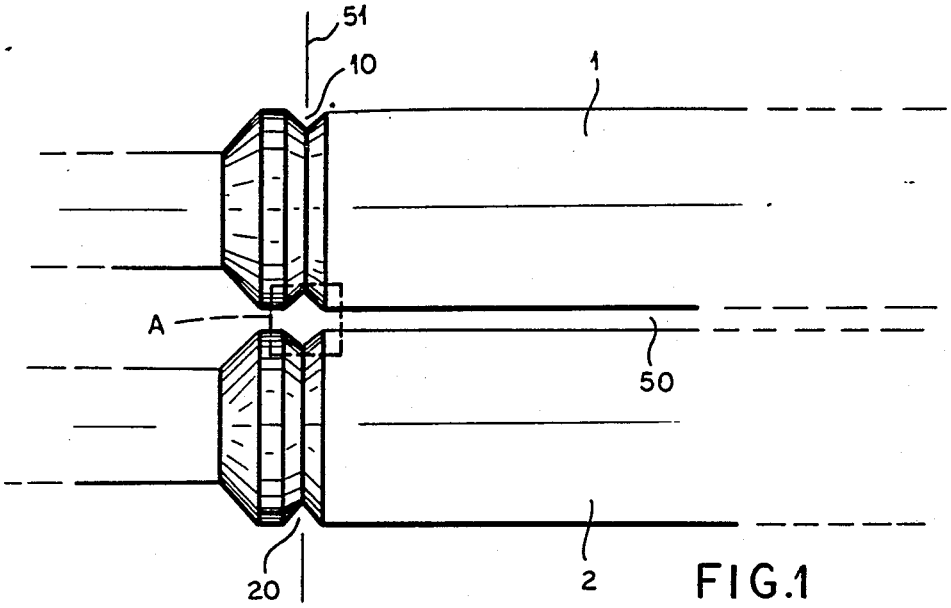
FIG. 1 is a vertical elevational view showing a portion of two rolling-mill rolls provided with grooves according to the invention.

As can be seen from FIG. 1, a pair of rolling-mill rolls 1 and 2 can extend horizontally to define a rolling gap 50 between them. The remainder of the rolling stand, bearing assemblies, means for detecting the gap 50 and like elements conventional in rolling mill stands have not been shown.

The rollers 1 and 2 are each formed with a V-section groove 10 and 20 with vertices in a common vertical plane 51.

Thus these grooves are aligned, at least in the starting position. To monitor the geometric stability of the rolls, we project light over an area A from one side of the rolls to the opposite side and register the pattern of the light which is thus transmitted.

Figure 2:
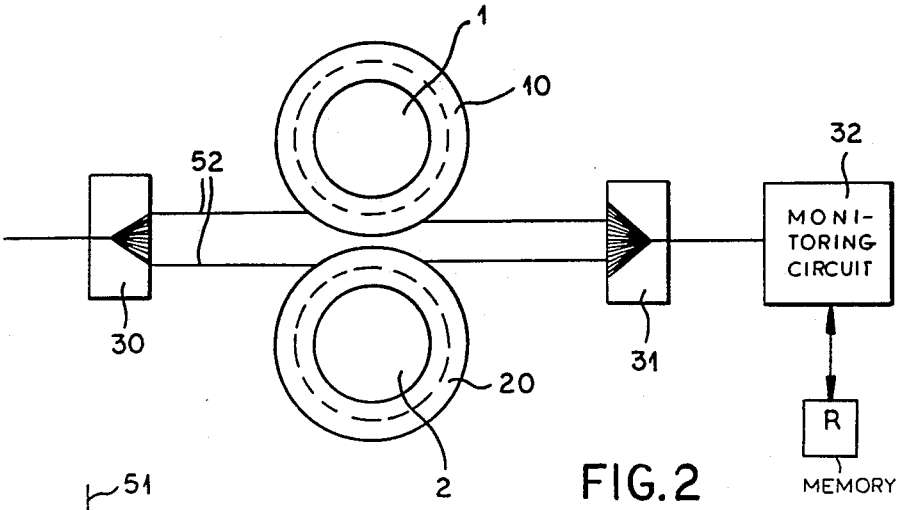
FIG. 2 is a diagrammatic side view illustrating the principles of the invention.

To this end, as shown in FIG. 2, we can provide a matrix array of laser beams 52 only upper and lower beams of which have been shown in FIG. 2 from a radiation source 30. The pattern forced by the grooves is collected by a detector 31. The pattern is recorded in a memory R at the commencement of the roller and is then followed diagrammatically during rolling. Both the source 30 and the detector 31 must be fixed with absolute stability with respect to one another and to the rolling stand.

The detector is connected to the unit 32 which monitors the geometric light image and compares it to the image for memory R at the state of rolling. Of course, the system can use a manual approach. For example, the starting pattern can be displayed and inscribed by hand on an overlay on a display screen, for example, with subsequent patterns being continuously displayed beneath the overlay. Deviations are then detected and appropriate adjustments made.

Figure 3:
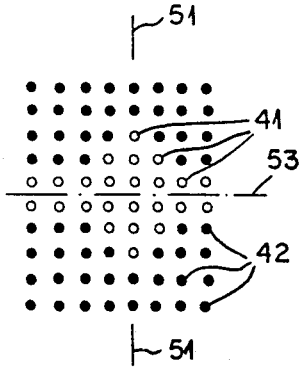
FIG. 3 represents diagrammatically the geometric pattern generated by the grooves of FIG. 1 utilizing the array of lasers of FIG. 2.
Figure 5:
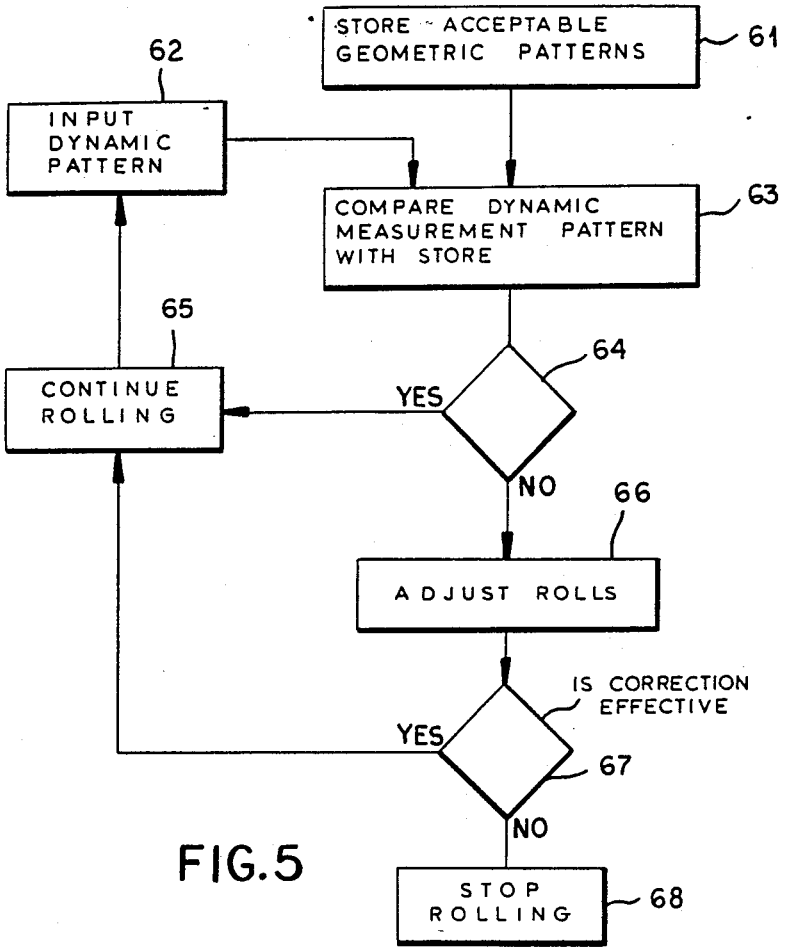
FIG. 5 shows an information-flow diagram for the microprocessor-controlled circuitry which can be used as part of the response circuitry of FIG. 2.

In FIG. 3 we have shown the plane 51 and a horizontal plane 53 from which it can be ascertained that, at the start, the pattern of transmitted light 41 is symmetrical. The dark points 42 represent the laser beams which have been intercepted.

Figure 4:
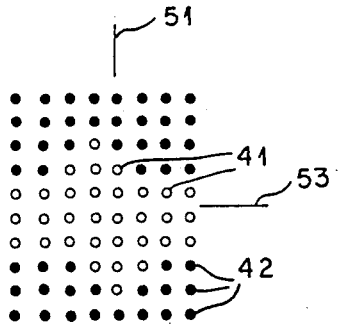
FIG. 4 shows a pattern in which there have been deviations both in the vertical and horizontal sense from the pattern of FIG. 3.

As rolling proceeds, the vertex of the upper portion of the pattern may shift to the left with respect to the plane 51 as shown in FIG. 4, thereby signaling a horizontal displacement of the upper roll from its desired position. Correction can then be undertaken to longitudinally reposition this roll.

Similarly, a vertical deviation can be signaled by the increase in area of the lower portion of the pattern as has also been shown in FIG. 4.

Of course, the circuit 32 need not exclusively constitute a display but can represent a microprocessor-controlled circuit capable of effecting a sample program as shown in FIG. 4.

Initially, at 61, acceptable geometric patterns are recorded. This shape can, of course, register the starting pattern and patterns which deviate slightly therefrom within tolerance limits.

As the rolling proceeds, the pattern is continuously input as shown at 62 and compared at 63 with the acceptable geometric patterns. If the continuous input in dynamic measurement patterns coincides with the acceptable geometric patterns as determined at 64, a continue rolling instruction is provided at 65 and the process continues.

If, however, the continuously detected rolling pattern deviates from the acceptable geometric pattern, a roll-adjustment signal is generated at 66 and if the correction is effective as detected at 67, rolling continues. However, if the correction cannot be effected, since tolerances have been exceeded, a stop-rolling instruction can be given as represented at 68.

We claim:

1. A method of continuously monitoring a pair of rolling-mill rolls dynamically which comprises the steps of:

forming respective circumferential grooves in each of said rolls but in a common plane whereby said grooves register with one another;

prior to commencement of a rolling operation training light through a space defined by said grooves and between said rolls from one side of said rolls so that an acceptable pattern of light is transmitted through said space to the opposite side of said rolls;

recording the acceptable pattern;

continuously during rolling operation training light through said space from said one side of said rolls;

detecting the pattern of light transmitted through said space on the opposite side of said rolls continuously during said rolling operation; and continuously comparing the detected pattern with the stored acceptable pattern.

2. The method defined in claim 1 wherein the light is projected from said one side through said space from a matrix array of laser beam sources and said pattern is detected on said other side by a matrix array of photo detectors individual to the laser beams of said sources.

3. In a combination with a pair of rolling-mill rolls, a system for dynamically monitoring a rolling operation which comprises:

respective circumferential grooves formed on said rolls in a common vertical plane;

means for projecting light between said rolls through said grooves from one side of said rolls;

detector means on the other side of said rolls for continuously detecting a pattern of light transmitted through said grooves during said operation; and circuit means responsive to said detector means for comparing the transmitted pattern of light with an acceptable pattern, said circuit means including means for storing as an acceptable pattern a light pattern transmitted through said grooves prior to the commencement of rolling.

4. The combination defined in claim 3 wherein said grooves have V-cross sections with respective vertices in said plane at least at the stage of rolling.

5. The combination defined in claim 3 wherein said means for projecting includes a matrix array of laser beam sources for projecting individual laser beams in a pattern of columns and rows against said rolls in the region of said grooves.

6. The combination defined in claim 5 wherein said detector means includes respective photo detectors assigned to each of said laser beams and responsive thereto.

* * * * *